United States Patent [19]

Teodorescu et al.

[11] 3,947,216

[45] Mar. 30, 1976

[54] BURNER FOR LIQUID FUELS

[75] Inventors: Constantin Gh. Teodorescu; Ilie C. Chiriac; Constantin I. Adam; Marin R. Diaconescu; Nicolae T. Dragan; Wilhelm F. Ber, all of Bucharest, Romania

[73] Assignee: Institutul Pentru Creatie Stiintifica Si Tehnica, Bucharest, Romania

[22] Filed: Aug. 5, 1974

[21] Appl. No.: 495,031

[30] Foreign Application Priority Data

Nov. 7, 1973 Romania ..... 76566

[52] U.S. Cl. ..... 431/352; 60/39.74 R; 431/243; 431/284

[51] Int. Cl.[2] ..... F23D 15/02

[58] Field of Search ..... 431/351–353, 431/242, 243, 284, 210; 60/39.74 R, 39.71, 39.72 R; 239/DIG. 7

[56] References Cited

UNITED STATES PATENTS

| | | | |
|---|---|---|---|
| 3,101,593 | 8/1963 | Britton et al. | 431/242 |
| 3,419,339 | 12/1968 | Schreter et al. | 431/284 |

*Primary Examiner*—Kenneth W. Sprague
*Assistant Examiner*—James C. Yeung
*Attorney, Agent, or Firm*—Karl F. Ross; Herbert Dubno

[57] ABSTRACT

An injector formed of an outer Coanda nozzle, consisting of three bodies, is located inside a flame stabilization cylinder, also introduced into a supplementary ejection nozzle. The front body is endowed with a baffle followed by an adjustable slot and continued by a Coanda profile having a recess with several orifices. The injector is simultaneously fed with air and fuel, which mix due to the depression created by the Coanda effect.

3 Claims, 4 Drawing Figures

BURNER FOR LIQUID FUELS

Figure 1:
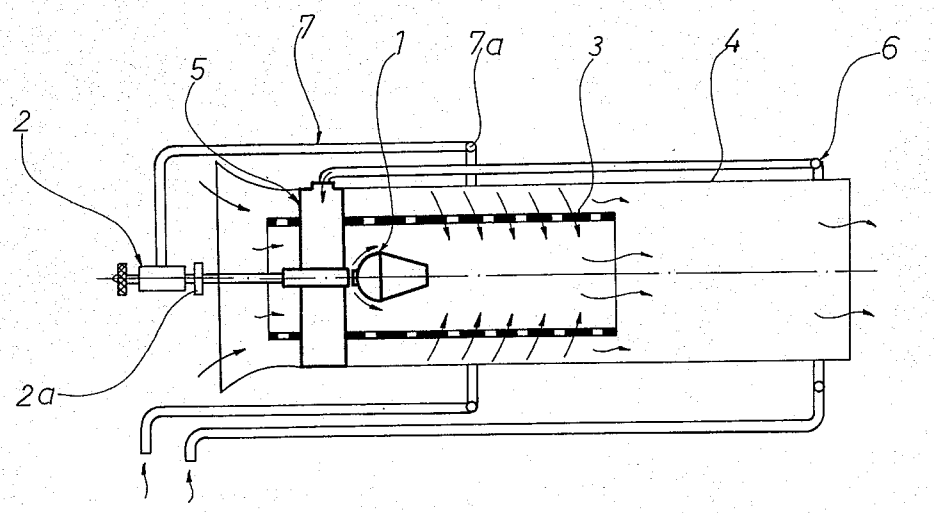

The prevent invention refers to a burner for liquid fuels, the pulverization being realized in shock waves and in ultrasonic field by an adequate arrangement of an outer Coanda nozzle.

A burner is known for liquid fuels endowed with pulverization head in which the liquid fuel is mixed with some fluid in order to be turned into a finely pulverized fog.

This burner has the disadvantage of an insufficiently high pulverization.

Burners are known based on the Coanda effect, using outer or inner nozzles and utilized only for gaseous fuels.

The burner for gaseous fuels, including an inner Coanda nozzle, consists of a body having an admission room which shapes the inner nozzle and is provided with an annular convergent nozzle built up between the terminus of the room gáte and the curvilinear end of the same admission room.

The annular nozzle forms an adjustable slot at its end, through which the fuel gas passes from a pipe.

The inner side of the body is endowed with an annular rectangular recess, which provokes a sudden gas deviation creating this way an increased depression and obtaining the Coanda effect on a Coanda polyhedric profile consisting of a number of steps correlated with one another by some angles and lenghths finding themselves in an adequate relation.

The steps form inside the body a convergent - divergent interlocking further on a diffuzer, having on it, at its other end, a burning head in which a deflector is mounted, endowed with radial paddles which are swirling and homogenize the gas and air mixture by paddle striking, and finally is endowed with a disk with holes and with a flame stabilizer having also holes.

At the same time, burners are known for gaseous fuels which realize the gas - air mixture using an outer Coanda nozzle consisting of a bulb with total or partial surface of revolution. This burner includes an intake chamber for the fuel gases which get out through an annular slot and below the continuous Coanda profile entraining, at the same time, the air necessary for the combustion.

The above mentioned burners expose the disadvantage that besides the fact of being used for gaseous fuels only, they do not secure through the ejection process generated by the Coanda effect, the whole air quantity necessary for combustion, this way leading to a polluting combustion and to low efficiency.

The burner for liquid fuels, according to the invention, avoids the above mentioned disadvantages by realizing the fuel pulverization in shock waves and in ultrasonic field using an injector which consists of an outer Coanda nozzle consisting of three bodies: front, middle and back, located inside a perforated flame stabilization cylinder introduced, in its turn, in a supplementary ejection nozzle which has its front section flared, the injector being fed simultaneously with compressed air and fuel, the fuel feeding being done through a delivery regulating device, a pipe and a built-up barrel and, similarly, the air feeding, through a delivery regulating device, a pipe, continued with a built-up barrel, and a channel made in a profiled blade.

Figure 2:
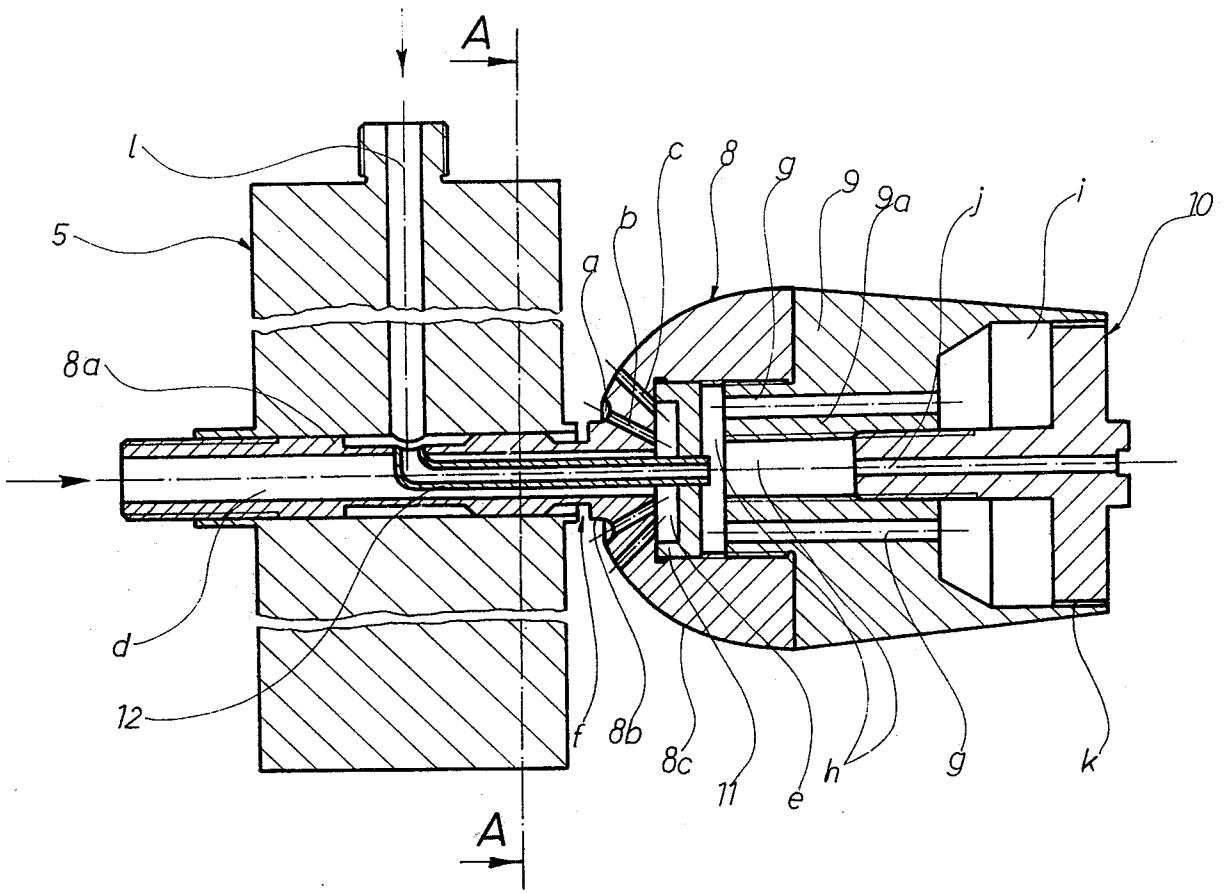
Figure 4:
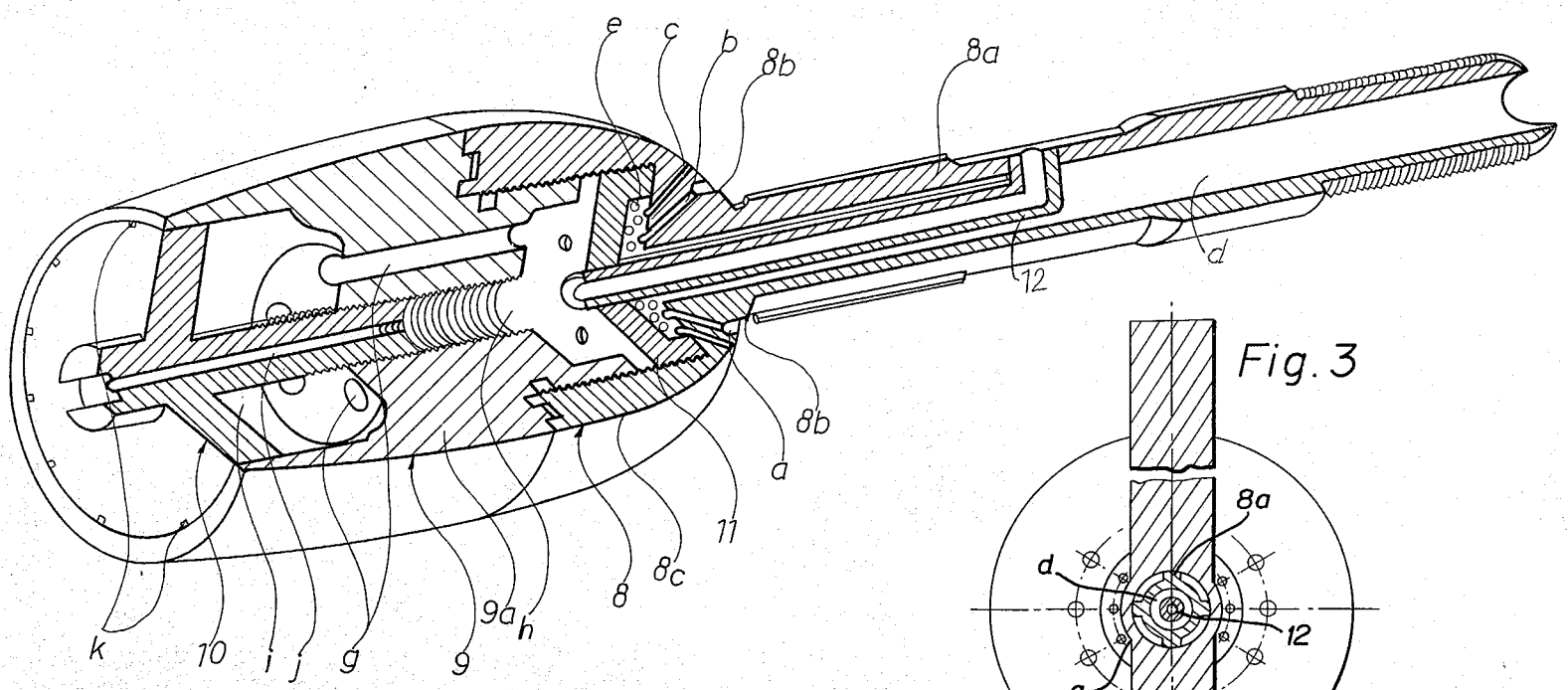
Figure 3:
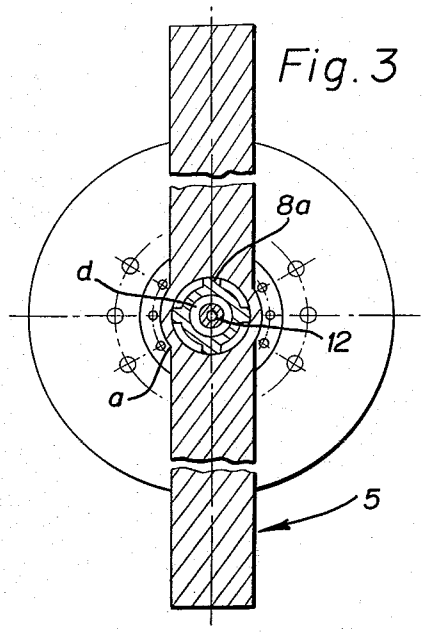

Here is an example of realizing the burner, according to the invention and in connection with the FIGS. 1, 2, 3 and 4 which represent:

FIG. 1, a general diagram of the burner;

FIG. 2, a longitudinal section through the fuel injector realized according to the invention;

FIG. 3, a cross-section through A — $A_1$, according to FIG. 2;

FIG. 4, an axial section of the fuel injector realized according to the invention.

The burner, according to the invention, consists of an injector 1 realized by an adequate arrangement of an outer Coanda nozzle and endowed at its front section with delivery regulating devices for the fuel 2 and for the air 2 *a*.

The injector 1 is mounted inside a perforated flame stabilization cylinder 3 placed, in its turn, in a supplementary ejection nozzle 4, and having an adequately profiled front section in order to diminish the local resistances to the air intake.

The injector 1 is fastened on the supplementary ejection nozzle 4 by means of a profiled blade 5 provided with a central channel *l* destined to the air intake.

On the outer part of the supplementary ejection nozzle 4 there is or there is not a built-up barrel 6 playing the part of a preheater for the active air which has an outstanding contribution to the functioning.

At the same time, the assembly has or has not a fuel preheating pipe 7 endowed with a built-up barrel 7 *a*.

The injector 1 used with the present invention consists of a front body 8, a profiled middle body 9 and a back body 10.

The front body 8 includes, in its turn, a partially grooved cylindrical section 8 *a*, a baffle 8 *b* in a right angle shaping one of the lateral walls of an adjustable slot *f*, the other wall of the same slot being shaped by an annular prologation of the profiled blade 5.

The same front body 8 is outerly continued with a Coanda profile 8 *c*.

On the profile 8 *c*, near to the baffle 8 *b* there is an adequately profiled recess *a* in which there are certain grooves *b* penetrating through the wall of the Coanda profile 8 *c* under a certain inclination.

On the same Coanda profile 8 *c* there is also another series of inclined grooves *c*, penetrating the Coanda profile, too.

Inside the front body 8 there is a channel *d* connected to the fuel feeding pipe.

Also inside the front body 8, about the Coanda profile 8 *c*, there is a plug 11, creating behind it an accumulation space *e* for the fuel which comes through the channel *d*. Inside the same channel *d* there is a duct 12 which communicates at one end with the profiled blade 5 for the air intake and at the other end pervades the plug 11.

The grooves *b* and *c* communicate with the accumulation space *e*.

The front body 8 is assembled with the middle profiled body 9 by means of a thread. Inside the middle profiled body 9 there are a number of channels *g* practicated in a separating wall 9 *a* facilitating the communication between a front space *h* and another space *i* located downhill the wall 9 *a*.

The space *i* is delimited by the middle profiled body 9 and by the back body 10.

The back body 10 is assembled with the middle profiled body 9 by means of a thread, the front element having a central channel *j* facilitating the communication between the space *h* and the environment.

On the circumference of the back body 10, along the generatrix, there are some grooves *k*, through which a supplementary quantity of air is evacuated under the form of thin jets in order to improve the pulverization and to intesificate the combustion process in the centre of the flame.

The burner functions as follows :

The air necessary for the function of the injector 1, having a certain pressure, enters the circuit, in which a built-up barrel 6 is mounted, and then the profiled blade 5 from which is separates into two flows, namely :

- a main flow issuing through a series of grooves from the area 8 *a* of the front body 8 getting into the slot *f*;
- a secondary flow getting through the duct 12, located inside the channel *d* of the front body 8, and entering the space *h*.

The main flow, leaving the slot *f*, clings to the Coanda profile 8 *c* realizing the Coanda effect. The so realized diverted jet creates a depression near the profile having as a result an entrainment of the atmospherical air inside the flame stabilization cylinder 3 and inside the supplementary ejection nozzle 4.

The evolution of the gases when getting out of the flame stabilization cylinder 3 provokes a supplementary ejection phenomenon inside the supplementary ejection nozzle 4 thus increasing the volume of air entrained from the atmosphere.

The secondary flow, existent within the space *h*, communicates both with the space *i* by means of the channels *g*, and with the atmosphere inside the flame stabilization cylinder 3 by means of the channels *j*, this way creating a central jet.

The air under pressure inside the space *i* communicates, at the same time, with the atmosphere inside the flame stabilization cylinder 3 by means of the grooves *k* giving birth to axial peripheric jets.

In the slot *f* and in the channel *j*, like in the grooves *k*, the parameters of the air flow have critical values.

The fuel at low pressure is directed or not through the fuel preheating duct 7 to the injector 1 by the delivery regulating device 2.

The fuel gets into the front body 8 through the channel *d* reaching the accumulation space *e* from where, due to the depression created by the Coanda effect near the grooves *b* and *c*, it is entrained to the exterior of the Coanda profile.

At the contact of the fuel jet and of the air jets passing through the slot *f* and through the grooves *k* a strong energy interchange takes place due to the shock waves characteristic to the critical evolution of the air through the slot *f* and through the grooves *k*, with the consequence of a fragmentation in very small particles of the fuel film.

At the same time, flowing with a high velocity through the slot *f*, through the grooves *k* and through the channel *j*, the air gives birth to an ultrasonic field which contributes to the increase of the degree of fineness of the fuel pulverization process.

The role of the recess *a*, in which the grooves *b* are penetrating, is to avoid the pulsation phenomenon of the fuel supply generated by the apparition of the shock waves as a consequence of the evolution of the compressed air at critical parameters.

The air and fuel particles mixture is compelled, due to the Coanda effect, to wash the profile of the injector 1, contributing to its cooling.

The air evacuated through the channel *j* in the center of the flame secures the homogenization of the fuel mixture contributing to the intensification of the combustion processes.

When the fuel is pulverized in the above mentioned conditions, the ignition takes place due to a certain system. The flame is unidirectionally direction downhill the injector 1 and is compelled to evolve axially being longitudinally stabilized by the flame stabilization cylinder 3.

Due to the ejection phenomena a quantity of air is entrained from the outer medium into the supplementary ejection nozzle 4. This supplementary air has the role of securing the complete combustion of the fuel.

The present invention exposes the following advantages:

- it secures a stoichiometric combustion mixture, permitting a high efficiency of the process of combustion;
- it concomitantly secures, by the ejection process generated by the Coanda effect and by the supplementary ejection nozzle, the whole quantity of air necessary for the combustion, making a supplementary air source unnecessary;
- it secures a particularly fine pulverization of the fuel without any special pumps for the supply with fuel;
- it allows a complete combustion of the heavy fuels, eliminating the apparition of deposits;
- it doesn't allow the flareback even in conditions of low air pressure;
- it allows the realization of a long or of a short flame depending on the technological process;
- it is of a simple, robust construction, with no moving parts and it is easily exploited;
- the burner can be used as an atomizer for any liquids when it has not the flame stabilization cylinder 3.

I claim:

1. A liquid-fuel burner comprising:

an outer generally cylindrical housing having an outwardly flared intake end and an outlet end remote from said intake end;

a perforated generally cylindrical flame stabilizer disposed in said housing and coaxial therewith while being spaced with substantially all-around clearance from the inner wall of said housing at said intake end thereof;

a profiled rib extending radially of said flame stabilizer in said housing;

an outer Coanda ejector mounted on said rib coaxial with said flame stabilizer and therein proximal to said intake end, said Coanda ejector comprising a body defining with said rib an annular outwardly opening slot, said body having a bulbous convex portion axially spaced from said slot toward said outlet end and rotationally symmetrical about the common axis of Coanda ejector and said flame stabilizer, said body thereafter converging toward said outlet end;

means for supplying combustion air to said slot; and means for feeding a liquid fuel to said body, said body being formed with a chamber receiving said fuel and with passages extending from said chamber toward said intake end and terminating along the surface of said bulbous portion of said body for discharging fuel therealong.

2. The burner defined in claim 1 wherein said means for supplying combustion air to said slot includes a duct surrounding said housing and in heat exchanging relationship therewith and wherein said means for feeding a liquid fuel to said body includes a duct surrounding said housing and in heat exchanging relationship therewith.

3. The burner defined in claim 3 wherein said body is provided with a plurality of channels opening in the direction of said outlet end, a compartment in said body spaced from said chamber and communicating with said channels, said means for supplying combustion air to said slots including a tube extending into said body and opening into said chamber, and a passage in said rib communicating with said tube for delivering combustion air thereto.

* * * * *